US006640711B2

(12) United States Patent
Smoot et al.

(10) Patent No.: US 6,640,711 B2
(45) Date of Patent: Nov. 4, 2003

(54) BRIDGE MANDREL FOR USE AS A REPEAT BUILDER IN A PRINTING MACHINE

(76) Inventors: Michael A. Smoot, 2716 Westlock Dr., Wilmington, DE (US) 19808; Gregory J. Gayle, 241 Benjamin Blvd., Bear, DE (US) 19701; Michael J. McGuinness, 2407 Tapley La., Wilmington, DE (US) 19808

( * ) Notice: Subject to any disclaimer, the term of this patent is extended or adjusted under 35 U.S.C. 154(b) by 0 days.

(21) Appl. No.: 10/050,803

(22) Filed: Jan. 15, 2002

(65) Prior Publication Data

US 2003/0131746 A1 Jul. 17, 2003

(51) Int. Cl.[7] ..... B41F 13/10

(52) U.S. Cl. ..... 101/375; 492/4; 492/28; 492/49; 492/52; 492/53; 101/376; 101/479; 101/401.1; 428/909

(58) Field of Search ..... 101/375, 376, 101/401.1, 479; 492/4, 5, 28, 39, 48, 49, 52, 53, 56; 428/304.4, 309.9, 317.1, 909

(56) References Cited

U.S. PATENT DOCUMENTS

| | | | | | |
|---|---|---|---|---|---|
| 3,152,387 | A | * | 10/1964 | Macleud | 492/56 |
| 3,467,009 | A | * | 9/1969 | Ross | 101/407 |
| 4,378,622 | A | * | 4/1983 | Pinkston et al. | 101/376 |
| 4,471,011 | A | * | 9/1984 | Spöring | 428/909 |
| 4,548,858 | A | * | 10/1985 | Meadows | 428/909 |
| 4,770,928 | A | * | 9/1988 | Gaworowski et al. | 101/401.1 |
| 4,903,597 | A | * | 2/1990 | Hoage et al. | 101/401.1 |
| 5,006,400 | A | * | 4/1991 | Pinkston et al. | 428/909 |
| 5,216,954 | A | * | 6/1993 | Thompson | 101/375 |
| 5,245,923 | A | * | 9/1993 | Vrotacoe | 101/375 |
| 5,256,459 | A | * | 10/1993 | Carlson | 101/375 |
| 5,264,289 | A | * | 11/1993 | Kondo et al. | 428/909 |
| 5,301,610 | A | * | 4/1994 | McConnell | 101/401.1 |
| 5,323,702 | A | * | 6/1994 | Vrotacoe et al. | 101/375 |
| 5,336,319 | A | * | 8/1994 | Narang et al. | 101/477 |
| 5,352,507 | A | * | 10/1994 | Bresson et al. | 428/909 |
| 5,431,989 | A | * | 7/1995 | Beltzung et al. | 428/909 |
| 5,440,981 | A | * | 8/1995 | Vrotacoe et al. | 101/375 |
| 5,486,402 | A | * | 1/1996 | Flint et al. | 428/909 |
| 5,644,985 | A | * | 7/1997 | Serain | 101/401.1 |
| 5,860,360 | A | * | 1/1999 | Lane, III et al. | 101/376 |
| 6,019,042 | A | * | 2/2000 | Batti et al. | 101/376 |
| 6,085,653 | A | * | 7/2000 | Goovaard et al. | 101/376 |
| 6,289,809 | B1 | * | 9/2001 | Sonobe | 101/401.1 |
| 6,401,613 | B1 | * | 6/2002 | Gayle | 101/375 |
| 2002/0002920 | A1 | | 1/2002 | Dilling et al. | |

FOREIGN PATENT DOCUMENTS

| | | |
|---|---|---|
| DE | 199 03 220 | 8/2000 |
| WO | WO 01/70505 | 2/2001 |
| WO | WO 01/89833 | 5/2001 |

* cited by examiner

*Primary Examiner*—Eugene H. Eickholt
(74) *Attorney, Agent, or Firm*—Connolly Bove Lodge & Hutz, LLP

(57) ABSTRACT

A bridge mandrel includes an inner sleeve assembly comprising the inner laminate and an outer laminate secured on each side of an intermediate hardened foam layer. The inner laminate is of multi-ply form with inner plies of base and adhesive layers separated from outer plies of base and adhesive layers by a compressible foam layer. The adhesive layers are made from high viscosity thermoplastic adhesive material. The intermediate layer is of segmented form with a radial gap between adjacent segments. A header is mounted to each end of the inner sleeve assembly.

47 Claims, 4 Drawing Sheets

BRIDGE MANDREL FOR USE AS A REPEAT BUILDER IN A PRINTING MACHINE

BACKGROUND OF THE INVENTION

In printing processes such as flexography, presses are used to transfer printed images to a substrate such as paper or plastic film. To accomplish this, printing plates are mounted to cylinders of specific diameters to achieve the desired length or "repeat" of the printed image. Thin sleeves have been used over the years as plate carriers to keep jobs mounted for repeated use. The sleeves are mounted onto cylinders, typically by expanding the thin sleeve via air pressure supplied to the cylinder interior. Upon removal of the pressurized air, the thin sleeve contracts and grips the cylinder, thus forming an integral unit. In recent years, repeat builders or "bridge mandrels" have been used to reduce the number of costly cylinders yet still achieve the repeat diameters required. These bridge mandrels tend to have a means of expanding over the base cylinder via air and gripping the base cylinder, after air removal. Another approach is to hold the bridge mandrel in place with hydraulic pressure. These bridge mandrels have various materials in place to provide the desired thickness. A means for supplying air to the outer diameter of the bridge mandrel is also provided to enable expansion of the thin carrier sleeve. The air supply typically passes through various layers of the laminated bridge mandrel structure. Further, a new type of press has been developed wherein the cylinder is fixed to the press in a cantilevered fashion with a removable bearing support on the opposite end to facilitate loading and unloading of bridge mandrels as well as thick sleeves. This type of arrangement is often referred to as a "fixed mandrel" press.

Bridge mandrels employing the prior art have been made from various materials. As weight became more critical, lightweight composites became the preferred material.

The approach generally taken in forming bridge mandrels is to produce an inner sleeve laminate made from a low viscosity, reinforced, thermoset resin material. Once the inner sleeve is fully cured, the sleeve may be machined to produce a smooth outer surface. A compressible foam material may then be bonded around the sleeve to facilitate expansion of the base sleeve. To prevent resin from penetrating the foam layer, various barrier materials are applied to the foam layer. A solid, rigid foam material is then applied to the surface of the sleeve/foam assembly, typically using an injection process. Once the foam layer has been applied, the surface can be machined to enable application of the final outer laminate that is typically comprised of a low viscosity thermoset material, either with or without reinforcement, which serves as the carrier for the outer thin sleeve. Air is supplied to the bridge mandrel by mounting inserts to the ends of the unit followed by drilling intersecting holes from the outer surface. Another method involves drilling holes through the laminate to allow air to pass from the inside to the outside of the bridge mandrel when supplied to the fixed mandrel.

There are several deficiencies with the prior art. First, the use of low viscosity, thermoset resins requires the use of multiple manufacturing steps to prevent the resin from penetrating into undesirable areas such as the compressible foam layer. Multiple steps are also required because the low viscosity resin systems tend to move and deform when the layers are applied all at once, causing buckling or waviness in the laminates. Second, the ends of the bridge mandrel are typically fully exposed, thus providing the opportunity for inks and solvents to be absorbed into the various layers of the laminate. This can lead to swelling of the bridge mandrel and a change in the diameter that leads to poor print registration and inferior print quality. Third, the ends of the bridge mandrel are easily damaged because the composite materials used tend to have low impact strength. A related problem is that a notch or key-way is often required on the inner diameter of the inner sleeve to position the bridge mandrel for print registration. Attempts have been made to employ metal inserts for this notch because composites are easily damaged through repeated impact with the pin on the fixed mandrel that must align with the notch. However, this approach tends to have a limited life since the composite is not well suited towards holding the metal insert securely for the life of the bridge mandrel. Finally challenges exist in preventing the air from going into the laminate layers and causing delaminations due to the porous nature of the materials used.

SUMMARY OF THE INVENTION

An objective of this invention is to provide a bridge mandrel that overcomes the above deficiencies.

In accordance with this invention the bridge mandrel body comprises a multi-ply inner laminate wrapped around a forming mandrel. An intermediate layer comprised of a rigid material is wrapped around the inner laminate to build thickness. An outer multi-ply laminate is wrapped around the intermediate layer to form the outer sleeve carrier laminate.

In accordance with one aspect of this invention the various components are mounted together on the same support or forming tool. The assembly is then inserted as a unit into an oven allowing it to be co-cured. This enables each laminate to experience the same thermal history and thus minimize conflicting thermal stresses.

In accordance with another aspect of this invention the inner laminate includes layers made from high viscosity thermoplastic material to control resin viscosity thus controlling resin flow.

In accordance with another aspect of this invention the rigid intermediate layer is made from segmented foam having generally radial gaps between adjacent pairs of side-by-side segments. Preferably, the radial surfaces of the segments are coated with a thermoset adhesive.

In accordance with another aspect of this invention the co-cured multi-ply bridge mandrel body is machined at the ends to accept end caps or "headers " that are bonded to the unit. These headers could include air passageways for effecting the expansion of an outer thin sleeve that would serve as the printing plate carrier to be mounted to the bridge mandrel for printing. The headers also serve to close off and protect the ends of the bridge mandrel laminate assembly from ink or solvent penetration and from damage due to mishandling during use.

THE DRAWINGS

DETAILED DESCRIPTION

The present invention relates to the improvements in a bridge mandrel which would be mounted around a fixed mandrel or integral cylinder in, for example, rotogravure or flexographic press wherein a printing cylinder is used for printing by having a sleeve mounted around the cylinder or mandrel with the sleeve carrying the printing plate. In printing operations it is necessary to use different diameter sleeves. This is accomplished by providing a bridge mandrel or repeat building cylinder between the fixed mandrel and the outer sleeve.

Figure 1:
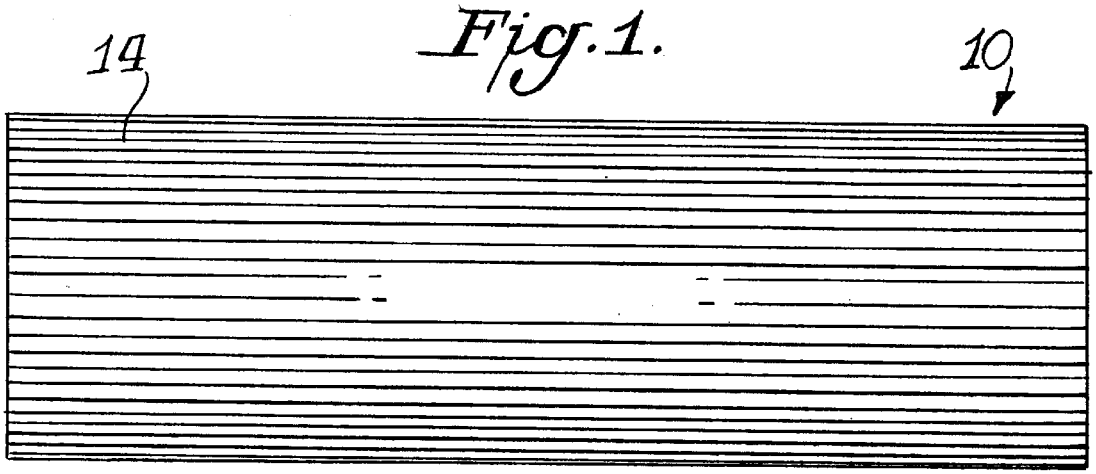
FIG. 1 is a side elevational view of a bridge mandrel body in accordance with this invention.
Figure 2:
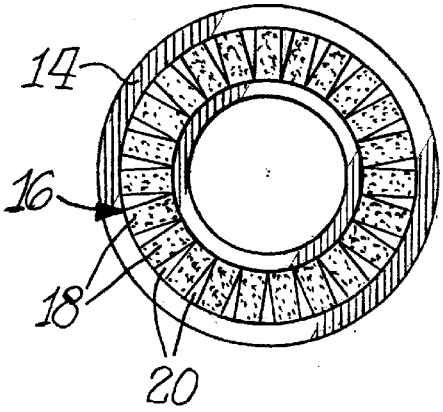
FIGS. 2–4 are end elevational views of alternative segmented foam intermediate layers of the bridge mandrel in accordance with this invention.

In general, the bridge mandrel of this invention includes an inner sleeve assembly formed by an inner laminate and an outer laminate with an intermediate layer(s) therebetween. The laminates and intermediate layer are cylindrical for fitting on the fixed mandrel and for receiving the outer thin sleeve. In accordance with the invention an end cap or header is mounted to each end of the bridge mandrel. FIGS. 1–2 illustrate a bridge mandrel 10 before application of the headers. As shown therein the inner laminate 12 is separated from the outer laminate 14 by an intermediate cylindrical layer 16. In a preferred practice of this invention, as later described, the intermediate layer 16 which is preferably made of a hard polyurethane foam or similar material is segmented into a plurality of individual radially extending segments 18 having a gap 20 between each set of adjacent segments.

Figure 3:
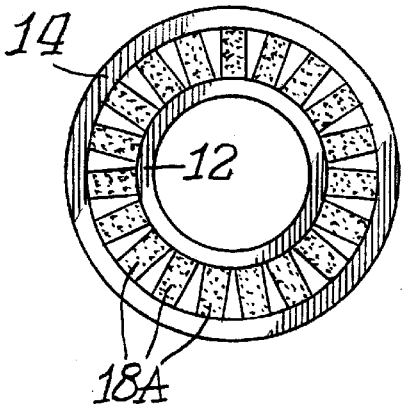
Figure 4:
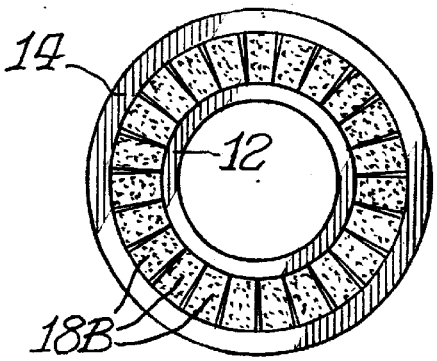

FIG. 2 illustrates the radial base of the segments 18 to be disposed against each other. FIG. 3 shows a variation where the segments 18A are sufficiently spaced apart that there is also a spacing between the base portions of each segment. The segments 18 and 18A shown in FIGS. 2–3 are each of generally rectangular shape. FIG. 4 illustrates a variation where the segments 18B are wedge shaped. Thus, the side surfaces of each segment 18B diverge away from each other radially outwardly rather than being generally parallel as shown in FIGS. 2–3. Preferably, the longitudinal centerline of each segment 18, 18A, 18B would intersect the central axis of the mandrel 10. Thus, each segment is preferably a radial segment. The invention could, however, be practiced with non-radial or offset segments.

Figure 5:
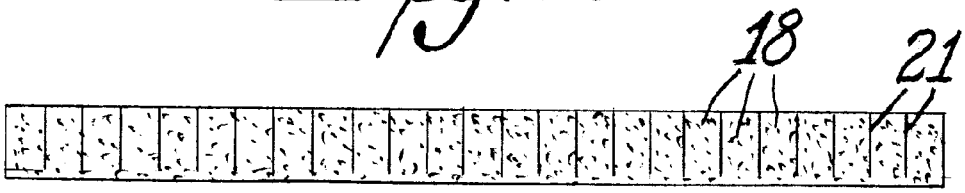
FIGS. 5–6 are side elevational views showing the formation of the segmented intermediate layer before being incorporated into the final bridge mandrel structure.
Figure 6:
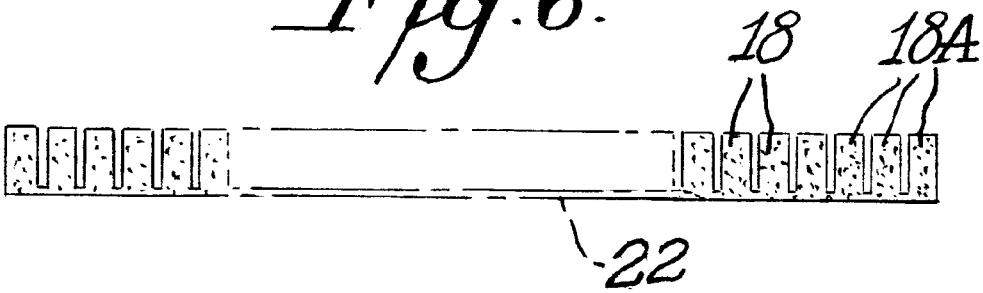
Figure 7:
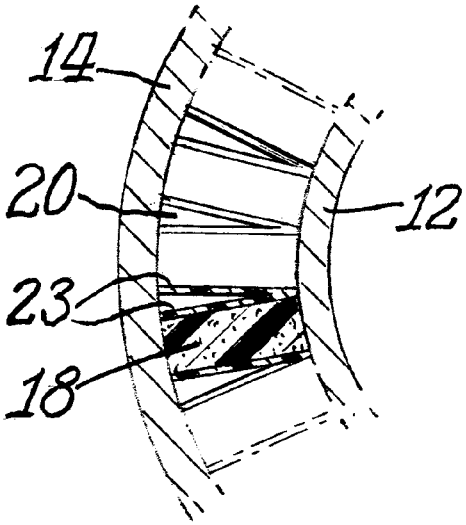
FIG. 7 is an end elevational view on an enlarged scale of the segmented layer shown in FIG. 4.

The segmented intermediate layer 16 could be formed in any suitable manner. FIG. 5 illustrates a block of hard rigid incompressible foam material which has a plurality of slits 21 to create the individual segments 18. When the block is bent to its cylindrical shape, as shown in FIG. 2, gaps 20 would form between the individual segments. Since there might be a tendency for a foam block having slits to crack at the slits, FIG. 6 illustrates a preferred practice where a supporting material such as scrim 22 is used to support a plurality of individual separate blocks 18A placed side by side. The segments could be initially disposed in surface contact with each other and would assume the final condition of FIG. 2, or could have a spacing between adjacent segments 18A. When the scrim is bent to a cylindrical shape the spaced segments 18A assume the position shown in FIG. 3.

The gaps 20 formed between adjacent segments 18 not only contribute to a weight reduction of the intermediate layer 16, but also form areas into which adhesive resin (later described) may flow. The resin 23 could then collect on and coat the radial surfaces of each segment 18. This adds to the strength of the individual segments desired. In addition, the resin coating seals the segments to prevent moisture from penetrating the segments. It is preferred, although not essential, that the gaps 20 should still have some empty space rather than being completely filled with excess resin so that the intermediate layer 16 will thereby not be too heavy.

The use of a segmented intermediate foam layer is a departure from conventional prior art practices where the foam layer is formed by injecting the material in situ which would result in a completely full generally solid cylindrical or ring shaped layer without any air gaps, in contrast to the segmented layer 16 of this invention.

Figure 8:
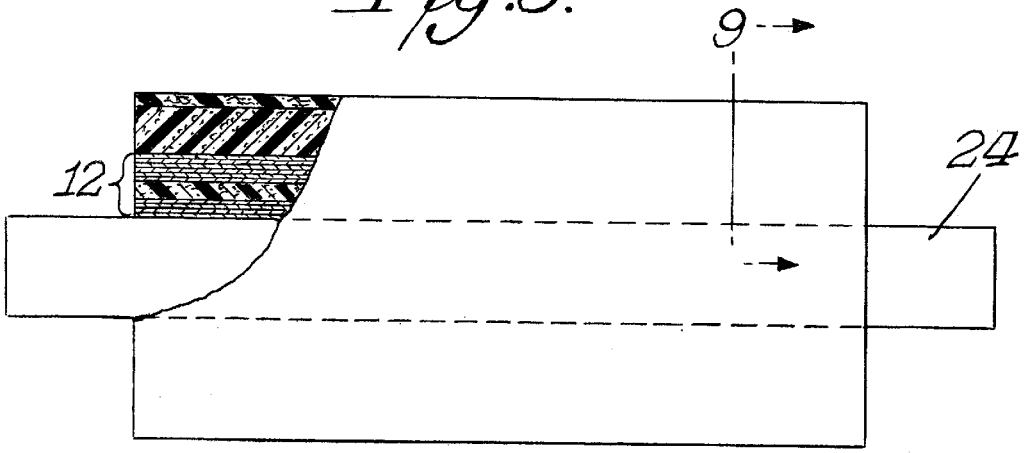
FIG. 8 is a side elevational view partly broken away showing the forming of the bridge mandrel in accordance with this invention.
Figure 9:
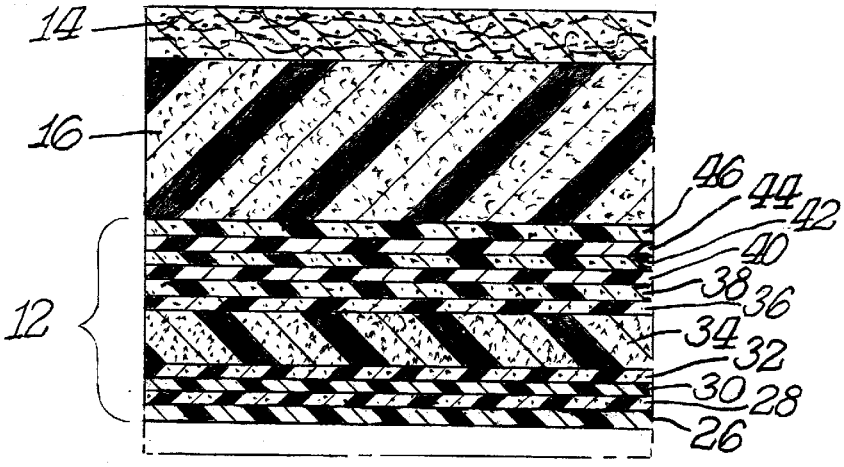
FIG. 9 is a cross-sectional view taken through FIG. 8 along the line 9—9.

FIGS. 8 and 9 illustrate the layer construction of the bridge mandrel blank which is essentially the bridge mandrel assembly without the end caps. As shown therein, a base tool 24 would serve as the support member on which the various laminates of the bridge mandrel are formed. Inner laminate 12 is formed over base tool 24. As best shown in FIG. 9, an inner ply consisting of a base layer 26 with a thermoplastic adhesive layer 28 is first wrapped around the mandrel or tool 24. A second ply consisting of base layer 30 and thermoplastic adhesive layer 32 and compressible foam layer 34 is wrapped around the previous layer. A third ply consisting of adhesive layer 36, base layer 38 and another adhesive layer 40 is wrapped around the previous layer. A fourth ply consisting of adhesive layer 42, base layer 44 and another adhesive layer 46 is wrapped around the previous layer. The layers of laminate 12 described above can be of any suitable dimension. For example, each adhesive layer or base layer may be from 0.003 to 0.030" thick. The compressible foam layer 34 may be from 0.030" to 0.100" thick. The layers may be spirally applied or wrapped in a single sheet. Preferred materials are a thermoplastic adhesive for layers 28, 32, 36, 40, 42 and 46, a polyester film for base layers 26, 30, 38 and 44, and a polyurethane foam for compressible foam layer 34. As a final step in preparing the inner laminate, a thin, narrow adhesive tape is used to cover the gaps or seams present in the last layers 44 and 46 of the inner laminate. This tape material prevents the adhesive that will be used to coat the intermediate layer and: the outer laminate from seeping between the gaps or seams and ultimately soaking into compressible layer 34. A preferred tape would be ½" wide masking tape.

Segmented foam intermediate layer 16 is next applied over the inner laminate 12 as shown in FIG. 9. The intermediate layer is a hard, generally incompressible layer that ranges in thickness from 0.20" to 1.5". The intermediate layer may be made from materials such as balsa wood, expanded plastic, or various closed or open foam products. The preferred material for intermediate layer 16 is a polyurethane foam with a density in the range of 8 to 20 pounds per cubic foot.

After applying intermediate layer 16, a low viscosity adhesive 23 is poured over the intermediate layer layers to aid in bonding to inner laminate 12, to reinforce the structural integrity of the intermediate layer and to aid in bonding to outer laminate 14 not yet applied. A thermosetting epoxy resin is the preferred adhesive for use with the intermediate layer.

After applying adhesive to the intermediate layer, an adhesive coated fabric or non-woven material is wrapped around the intermediate layer to form outer laminate 14. Successive wraps are made until the desired thickness is achieved. The outer laminate thickness may range from 0.100" to 0.600". The preferred material for the outer laminate is a polyester non-woven coated with an epoxy thermosetting resin. Once the bridge mandrel blank is constructed over the forming mandrel, the assembly is placed in an oven for curing. The cure cycle can be varied depending upon the specific adhesive systems used. The preferred cure cycle for the preferred materials is 225° F. for a sufficient time to effect curing. As a result of this co-cured process, all layers experience the same thermal history. As a result of the curing process and the coefficient of thermal expansion between the forming mandrel and the bridge mandrel materials, the resulting inner diameter of inner laminate 12 is less than the outer diameter of fixed mandrel 66 onto which the bridge mandrel will ultimately be mounted. (See FIG. 11) The degree of interference between the bridge mandrel and the fixed mandrel ranges from 0.05% to 0.3% of the fixed mandrel diameter.

It is to be understood that the above description of the individual layers of the inner laminate is not intended to be limited with regard to the number of layers, the materials used, the specific dimensions or the steps in the lay-up process. For example, it may be desirable to form inner laminate 12 as a unit offline and separate from the bridge mandrel construction. This would be advantageous if large quantities of certain sizes were required and economics were favorable towards making large quantities of the inner laminate using a highly cost effective process such as spiral winding. As another example, while not shown in FIG. 9, an additional ply consisting of a base layer and adhesive layers on both sides may be wrapped around intermediate layer 16 to aid in bonding between the intermediate layer and the outer laminate. This added ply may reduce the propensity for the adhesive used to coat the outer laminate from moving into the air gaps within the intermediate layer. As a final example, it may be desirous to incorporate multiple intermediate layers with adhesive material between each layer to provide even greater bridge mandrel diameters than may be afforded by a single intermediate layer.

Figure 10:
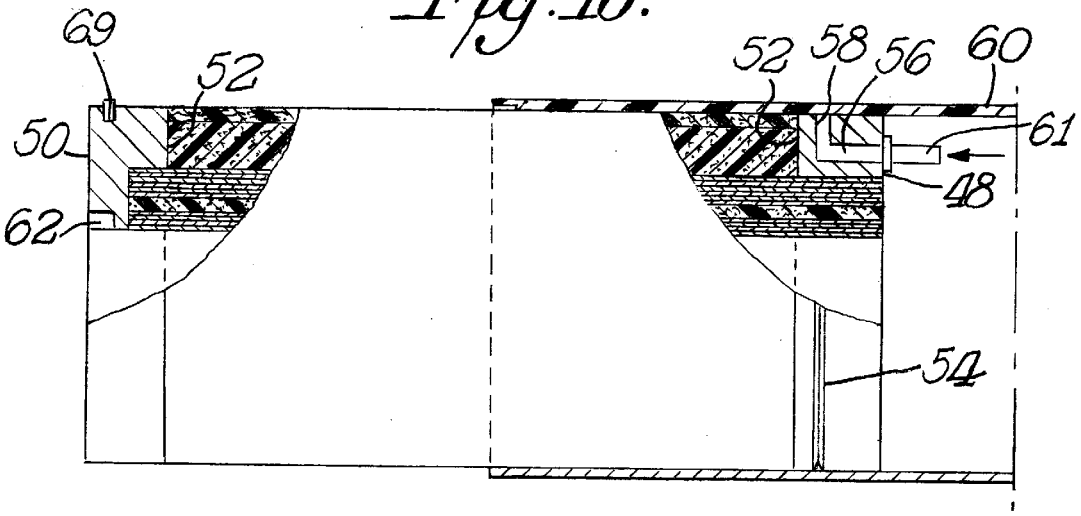
FIG. 10 is a side elevational view showing the addition of the end caps and the mounting of an outer sleeve to the bridge mandrel in accordance with this invention.
Figure 11:
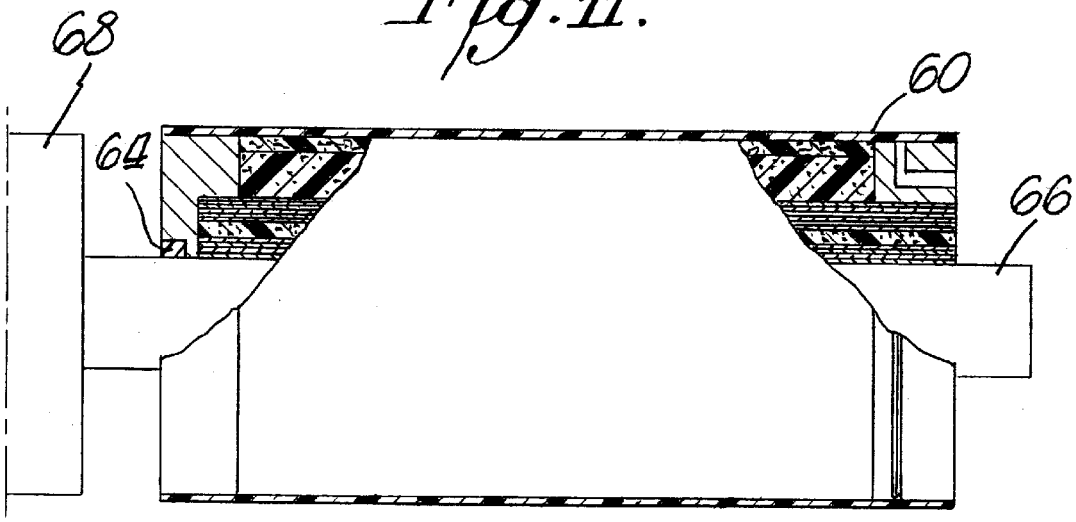
FIG. 11 is a side elevational view showing the bridge mandrel of this invention mounted to a fixed mandrel.

After the inner sleeve assembly has been cured the assembly is then conditioned for receiving end caps or headers 48,50 which are shown in FIGS. 10 and 11. The headers are of generally ring shaped or tubular construction and fit against the open ends of the inner sleeve assembly. The headers may be made from aluminum, plastic or composite material. In order to receive the headers the inner sleeve assembly is machined such as by grinding the ends to form a lap joint 52 of complementary shape to the stepped configuration of the inner end wall of each respective header 48,50 as illustrated in FIG. 10. The headers may be mounted to the inner sleeve assembly in any suitable manner. Preferably, the mounting is through use of a suitable adhesive such as a high viscosity thermoset adhesive resin. Headers 48,50 differ from each other in accordance with their intended functions. For example, header 48 includes a peripheral groove 54 completely around the outer surface of header 48. The outer side wall of header 48 has an air inlet opening 56 which communicates with groove 54 by passageway 58. Thus, the inner sleeve assembly or bridge mandrel could have an outer sleeve or printing sleeve 60 mounted thereon by supplying air through a nozzle 61 into the air inlet openings 56. This would cause the lead end of sleeve 60 to expand. The outer sleeve 60 could thereby be mounted by sliding the sleeve over the header 48. The air flow would cause outer sleeve 60 to expand sufficiently so that it could be progressively pushed over the entire length of the inner sleeve assembly in a known manner.

In a preferred practice of the invention, notch 62 (FIG. 10) is machined into end cap 50 to receive key 64 (FIG. 11) located on fixed mandrel 66 which is attached to base 68 of the printing press. This aids in aligning the bridge mandrel on the fixed mandrel and ensuring proper print registration. In addition, sleeve locating pin 69 is located at the outer diameter of end cap 50 for the purpose of positioning the thin sleeve 60 as it is mounted onto the bridge mandrel. The locating pin 69 will engage a sleeve notch when sleeve 60 has traveled the full length of the bridge mandrel. Typically, printing plates are mounted to the sleeve prior to mounting onto the bridge mandrel. The bridge mandrel with the sleeve and printing plates mounted to the sleeve is mounted onto the fixed mandrel or integral cylinder in much the same manner as thin sleeve 60 is mounted onto the bridge mandrel. Air is supplied to fixed mandrel 66 and exits the fixed mandrel near the end opposite base unit 68. As the bridge mandrel is directed onto the fixed mandrel, the air forces layers 26 through 32 of the inner laminate to expand by compressing compressible layer. 34. The inner laminate rides on a cushion of air as it travels the length of the fixed mandrel or integral cylinder. As the bridge mandrel contacts key 64, it is rotated until notch 62 engages the key, thus positioning the bridge mandrel relative to the fixed mandrel. Once positioned, the air supply to the fixed mandrel is cut off, causing the inner laminate to close onto the fixed mandrel with a tight grip due to the interference fit between the two cylindrical bodies. The grip strength of the bridge mandrel inner laminate is sufficient to prevent the bridge mandrel from rotating relative to the fixed mandrel. When a printing job having different print repeat length is required, the current bridge mandrel and sleeve is removed and a bridge mandrel having a larger or smaller diameter is used. Thus, the dimensions previously given as to the thickness of the various layers would vary based upon the required bridge mandrel diameter.

The invention might also be practiced where the bridge mandrel is used for mounting a thin carrier sleeve, such as sleeve 60, but where the air supply is provided by an air passage which extends completely through layers 12, 14 and 16 by having the air supplied below the inner surface of layer 12 similar to the type of arrangement used for mounting the bridge mandrel on a fixed mandrel.

The previous description relates to a practice of the invention wherein the bridge mandrel 10 is used for mounting a thin carrier sleeve. Accordingly, the bridge mandrel 10 is provided with air flow capability to facilitate mounting the sleeve 60 on the bridge mandrel. It is to be understood, however, that the invention may also be practiced where the bridge mandrel itself carries a printing plate, thus avoiding the need for a carrier sleeve. In such practice of the invention the modified bridge mandrel is actually a thick sleeve. It is thus to be understood that as used herein the term "bridge mandrel" is intended to also apply to "thick sleeve".

Figure 12:
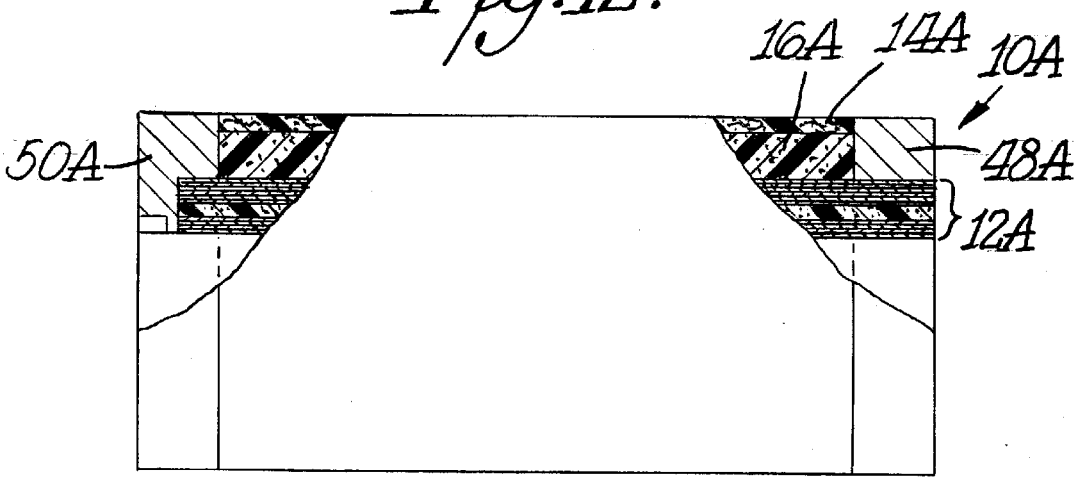
FIG. 12 is a side elevational showing a thick sleeve in accordance with this invention without supplied air capability for use without a thin carrier sleeve.

FIG. 12 illustrates such a modified form of bridge mandrel or thick sleeve 10A which would still incorporate an inner laminate 12A separated from an outer laminate 14A by an intermediate cylindrical layer 16 The structure of these members could be the same as their corresponding members 12, 14 and 16 previously described. In addition, headers 48A and 50A could be provided. Header 50A would be similar to header 50 previously described. Header 48A, however, would differ from header 48 in that header 48A would not include the air passage structure.

Although FIG. 12 illustrate the thick sleeve 10A to include an intermediate rigid layer 16A, the invention could be practiced where the thick sleeve or bridge mandrel does not include an intermediate layer. Instead the inner laminate 122 would have the overwrap or outer laminate 14 applied directly over laminate 12.

An important feature of the invention is the use of thermoplastic adhesives rather than thermoset adhesives at strategic locations within the laminates. The use of a high viscosity thermoplastic adhesive avoids a problem with the prior art use of thermoset adhesives which would tend to flow into the compressible foam layer. Preventing resin from filling the seams of compressible foam layer 34 or soaking into the foam layer itself is very important towards maintaining the compressibility of the layer and the ability of inner sleeve layers 26 through 32 to expand. To accomplish this the resin viscosity must be sufficiently high at the curing temperature of the bridge mandrel assembly. Characteristics of the resin at the cure temperature is similar to that of natural rubber or other elastomeric products prior to vulcanization. It is soft and pliable yet will not flow without the addition of pressure. The high viscosity material eliminates the need for barriers against adhesive penetration against the compressible foam layer. The viscosity is preferably sufficiently high that the adhesive resin will not readily flow when in the vertical position. The high viscosity material eliminates the need for barriers against adhesive penetration against the compressible foam layer. To the extent that the thermoplastic adhesive does flow the viscosity is such that the adhesive fills the seam of spirally wrapped inner layer 26 during cure thus eliminating the potential for air loss along the gaps when the bridge mandrel is ultimately mounted to mandrel 26.

Headers 48 and 50 also represent a distinct advantageous feature of the invention. The headers have several functions. First, they close off the ends of the inner sleeve assembly 12 and the intermediate layer 16 thereby preventing inks and solvents from entering at the ends as well as minimizing the effects of humidity. Second, they provide the means to supply air to the periphery of the bridge mandrel thus enabling expansion and mounting of outer sleeve 60. Finally, the headers are made of a lightweight, tough material such as aluminum that greatly enhances the durability of the unit and protects the more fragile layers 12, 14 and 16.

The bridge mandrel of the present invention thus overcomes various problems with conventional bridge mandrels by providing a simpler, more repeatable process, producing a durable, solvent resistant product having a consistent diameter along it's length which is particularly desirable where registration is important in the printing operation.

What is claimed is:

1. A bridge mandrel comprising a cylindrical inner laminate for being mounted on and around a fixed mandrel and the like, a cylindrical outer laminate mounted around and to said inner laminate, said inner laminate and said outer laminate being permanently mounted together to form an integral unit comprising a sleeve assembly, said inner laminate being of multi-ply construction comprising a plurality of inner plies made of base and adhesive layers and a plurality of outer plies made of base and adhesive layers with said plurality of inner plies being separated from said plurality of outer plies by a compressible foam layer, and said adhesive layers being made from a high viscosity thermoplastic material.

2. The mandrel of claim 1 including an intermediate cylindrical layer made of a hard rigid incompressible material between said inner laminate and said outer laminate to form part of said sleeve assembly.

3. The mandrel of claim 2 including adhesive tape wrapped around said inner laminate to cover any gaps and seams for preventing seepage outwardly of said inner laminate into said compressible foam layer.

4. The mandrel of claim 2 wherein said intermediate layer is of segmented construction having generally radial gaps between individual adjacent segments.

5. The mandrel of claim 4 wherein the radial surfaces of each of said segments is coated with a low viscosity thermoset adhesive.

6. The mandrel of claim 5 including a header mounted at each end of said inner sleeve assembly, and each of said headers being of tubular shape and having the same outside diameter as the outside diameter of said inner sleeve assembly.

7. The mandrel of claim 6 wherein one of said headers includes a peripheral groove on its outer surface, said one header having an air inlet in a side wall of said one header, and an air passageway communicating between said air inlet and said peripheral groove.

8. The mandrel of claim 7 wherein the other of said headers has a smooth outer surface without any peripheral groove.

9. The mandrel of claim 7 wherein said other of said headers includes a notch on its inner surface for receiving a key on a fixed mandrel.

10. The mandrel of claim 9 wherein said other of said headers includes a locating pin on its outer surface for engagement with a notch in a carrier sleeve when a carrier sleeve is mounted around said bridge mandrel.

11. The mandrel of claim 10 in combination with a thin plate carrying carrier sleeve mounted around said bridge mandrel, said carrier sleeve having a notch, said sleeve locating pin being located in said notch, said combination further including a fixed mandrel, said bridge mandrel being mounted around said fixed mandrel, and said fixed mandrel having a key received in said notch of said other of said headers.

12. The mandrel of claim 7 wherein each of said headers is made from aluminum, plastic or composite material.

13. The mandrel of claim 2 wherein said intermediate layer is of segmented construction having generally radial gaps between individual adjacent segments.

14. The mandrel of claim 13 wherein the radial surfaces of each of said segments is coated with a low viscosity thermoset adhesive.

15. The mandrel of claim 13 including a header mounted at each end of said inner sleeve assembly, and each of said headers being of tubular shape and having the same outside diameter as the outside diameter of said inner sleeve assembly.

16. The mandrel of claim 15 wherein one of said headers includes a peripheral groove on its outer surface, said one header having an air inlet in a side wall of said one header, and an air passageway communicating between said air inlet and said peripheral groove.

17. The mandrel of claim 1 including a header mounted at each end of said inner sleeve assembly, and each of said headers being of tubular shape and having the same outside diameter as the outside diameter of said inner sleeve assembly.

18. The mandrel of claim 17 wherein one of said headers includes a peripheral groove on its outer surface, said one header having an air inlet in a side wall of said one header, and an air passageway communicating between said air inlet and said peripheral groove.

19. The mandrel of claim 1 in combination with a fixed mandrel, and said bridge mandrel being mounted to and around said fixed mandrel.

20. The combination of claim 19 including a thin carrier sleeve mounted around said bridge mandrel.

21. A bridge mandrel for being mounted on a fixed mandrel comprising a cylindrical inner laminate for being mounted on and around the fixed mandrel, an intermediate cylindrical layer made of a hard rigid incompressible material mounted around and to said inner laminate, a cylindrical outer laminate mounted around and to said intermediate layer, said inner laminate and said intermediate layer and said outer laminate being permanently mounted together to form an integral unit comprising a sleeve assembly, and a cylindrical header mounted to each end of said sleeve assembly.

22. The mandrel of claim 21 wherein one of said headers includes a peripheral groove on its outer surface, said one header having an air inlet in a side wall of said one header, and an air passageway communicating between said air inlet and said peripheral groove.

23. The mandrel of claim 22 wherein the other of said headers includes a notch on its inner surface for receiving a key on a fixed mandrel.

24. The mandrel of claim 23 wherein said other of said headers includes a locating pin on its outer surface for engagement with a notch in a carrier sleeve when a carrier sleeve is mounted around said bridge mandrel.

25. The mandrel of claim 24 in combination with a thin plate carrying carrier sleeve mounted around said bridge mandrel, said carrier sleeve having a notch, said locating pin being located in said notch, said combination further including a fixed mandrel, said bridge mandrel being mounted around said fixed mandrel, and said fixed mandrel having a key received in said notch of said other of said headers.

26. The mandrel of claim 21 in combination with a fixed mandrel, and said bridge mandrel being mounted to and around said fixed mandrel.

27. The mandrel of claim 26 including a thin carrier sleeve mounted around said bridge mandrel.

28. The mandrel of claim 21 wherein each of said headers is made from aluminum material.

29. The mandrel of claim 21 wherein one of said headers includes at least one vertical passageway communicating with the exterior of said header for feeding air through said header to the exterior of said header to facilitate the mounting of a sleeve over said mandrel.

30. The mandrel of claim 29 wherein there is only one vertical passageway which communicates with a peripheral groove on the outer surface of said one header.

31. A bridge mandrel for being mounted on a rotatable fixed mandrel comprising a cylindrical inner laminate for being mounted on and around the fixed mandrel, an intermediate cylindrical layer made of a hard rigid incompressible material mounted around and to said inner laminate, a cylindrical outer laminate mounted around and to said intermediate layer, said inner laminate and said intermediate layer and said outer laminate being permanently mounted together to form an integral unit comprising a sleeve assembly, and said intermediate layer being generally radially segmented to create a plurality of side by side segments having a radial gap between each pair of said side by side segments.

32. The mandrel of claim 31 wherein said intermediate layer is a hardened foam material.

33. The mandrel of claim 31 wherein said intermediate layer is of segmented construction having generally radial gaps between individual adjacent segments.

34. The mandrel of claim 31 wherein each of said segments is generally rectangularly shaped.

35. The mandrel of claim 31 wherein each of said segments is wedge shaped.

36. The mandrel of claim 31 wherein the radial surfaces of each of said segments is coated with a low viscosity thermoset adhesive.

37. A method of making a bridge mandrel comprising forming a cylindrical multi-ply inner laminate on and around a cantilevered support tool by wrapping a plurality of inner plies of base and adhesive layers around the support tool, wrapping a compressible foam layer around the plurality of inner plies, wrapping a plurality of outer plies of base and adhesive layers around the compressible foam layer to form the inner laminate, the adhesive layers being made from high viscosity thermoplastic material, forming a cylindrical intermediate layer of hard rigid incompressible material around the inner laminate while the inner laminate remains on the tool, forming a cylindrical outer laminate around the intermediate layer while the inner laminate and the intermediate layer remain on the tool, the inner laminate and the intermediate layer and the outer laminate comprising an inner sleeve assembly, and heating the inner sleeve assembly in an oven so that the components of the inner sleeve assembly are co-cured to create the same thermal history thereof.

38. The method of claim 37 including mounting a header on each end of the inner sleeve assembly.

39. The method of claim 38 including providing a peripheral groove it the outer surface of one of the headers which communicates with a passageway and inlet hole in that header, and providing a notch in the inner surface and allocating pin on the outer surface of the other of the headers.

40. The method of claim 38 wherein the ends of the inner sleeve assembly are machined to accept the headers with the machining being done while the inner sleeve assembly is mounted on the support tool.

41. The method of claim 40 wherein the headers are mounted to the inner sleeve assembly after the inner sleeve assembly has been removed from the tool.

42. The method of claim 38 wherein the headers are mounted to the inner sleeve assembly after the inner sleeve assembly has been removed from the tool.

43. The method of claim 37 including segmenting the intermediate layer into a plurality of generally radially extending segments with a gap between adjacent segments.

44. The method of claim 43 including coating the radial surface of each of the segments with a low viscosity thermoset adhesive.

45. The method of claim 43 including segmenting the intermediate layer by mounting the individual segments on a support scrim, and then bending the support scrim into a circular shape.

46. The method of claim 43 wherein each segment is generally rectangular in shape.

47. The method of claim 43 wherein each segment is generally wedge shaped.

* * * * *